United States Patent [19]

Fritzinger

[11] 4,371,863

[45] Feb. 1, 1983

[54] TRAFFIC-ACTUATED CONTROL SYSTEMS PROVIDING AN ADVANCE SIGNAL TO INDICATE WHEN THE DIRECTION OF TRAFFIC WILL CHANGE

[76] Inventor: George H. Fritzinger, 15 Standish Ave., West Orange, N.J. 07052

[21] Appl. No.: 87,583

[22] Filed: Oct. 22, 1979

Related U.S. Application Data

[63] Continuation-in-part of Ser. No. 905,350, May 12, 1978, Pat. No. 4,200,860, which is a continuation-in-part of Ser. No. 681,539, Apr. 29, 1976, abandoned.

[51] Int. Cl.[3] ..... G08G 1/096; G08G 1/07

[52] U.S. Cl. ..... 340/43; 340/37; 340/41 R

[58] Field of Search ..... 340/43, 41 R, 37, 35, 340/44, 41 A, 40, 42; 116/63 R, 63 P

[56] References Cited

U.S. PATENT DOCUMENTS 2,016,220 10/1935 Anderson ..... 340/43
2,057,186 10/1936 Freeberg ..... 340/43
3,150,349 9/1964 Wilcox ..... 340/37

FOREIGN PATENT DOCUMENTS 2711378 9/1978 Fed. Rep. of Germany ..... 340/43

*Primary Examiner*—James J. Groody

[57] ABSTRACT

An equipment is provided in connection with a traffic actuated controller to cut off the traffic actuation to shift the controller to a fixed time basis at a predetermined interval before the direction of traffic will change, and at the same time provide an advance signal for motorists to enable them to gauge their driving to save gasoline and to achieve greater safety. The green signal is continued during the first portion of this fixed interval until the yellow clearance interval begins. A specific feature resides in the provision of a circuit adjunct including an adjustable timer, which can be connected externally to existing controllers to cut off the traffic actuation and feed out the advance signal at the setting of one adjustable control and to terminate the green signal and start the yellow signal at the setting of another adjustable control.

7 Claims, 2 Drawing Figures

Figure 1:
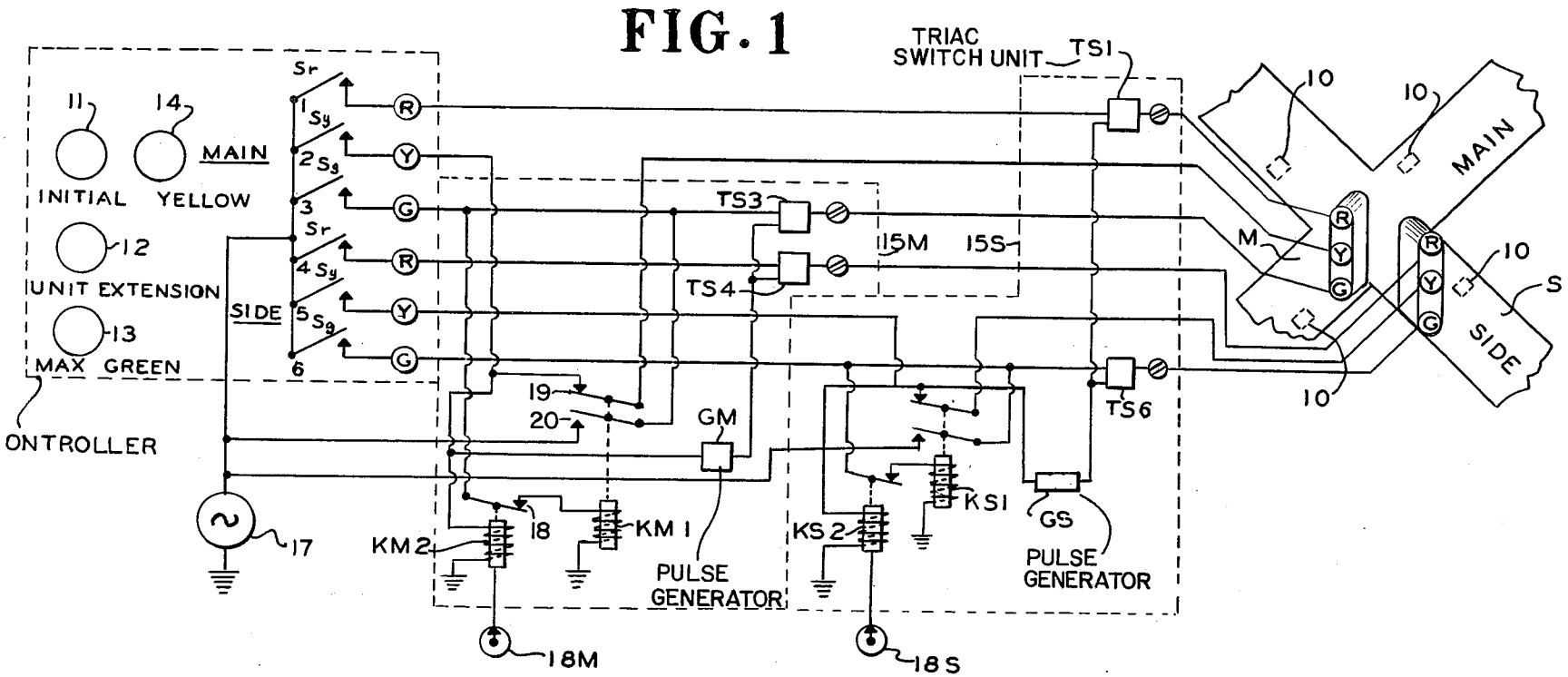

TRAFFIC-ACTUATED CONTROL SYSTEMS PROVIDING AN ADVANCE SIGNAL TO INDICATE WHEN THE DIRECTION OF TRAFFIC WILL CHANGE

CROSS REFERENCE TO RELATED APPLICATIONS

This application is a continuation-in-part of my application Ser. No. 905,350 filed May 12, 1978, now U.S. Pat. No. 4,200,860 issued Apr. 29, 1980, which in turn was a contination-in-part of my application Ser. No. 681,539 filed Apr. 29, 1976 and abandoned on the filing of application Ser. No. 905,350.

This invention relates to a method and apparatus for introducing a blink signalling of the character described and claimed in the above parent application into traffic systems using traffic actuated controllers.

In accordance with the parent application a blink signal is provided which is readily visible but so fast it cannot be confused with a flash signal and so short it does not distract attention from the main signalling. Such signal may, for example, consist of two blinks each of $\frac{1}{8}$th second duration separated by an "on" signal of $\frac{1}{8}$th second, for a total duration of $\frac{3}{8}$th second. This blink signalling has been disclosed in connection with traffic systems operating on a fixed-time cycle. In such systems switch connections can be readily made with the controllers, especially if of the mechanical type, to generate blink signals at any preset interval or intervals before the direction of traffic will change without changing the timing of the cycle of the controller.

Traffic actuated controllers work from the green signal on a floating basis depending on the flow of traffic until the yellow clearance interval of the cycle is reached. So long as such controllers are subject to traffic actuation, a blink signal cannot be introduced to indicate a predetermined fixed interval before the direction of traffic will change. By the present invention, a blink signal is introduced into traffic actuated systems at a preset time before the direction of traffic will change by working from the yellow-clearance control.

An object of the invention is to provide a modified traffic actuated controller which enables the traffic actuation to be cut off and an advance signal to be provided at a preset time before the direction of traffic is changed, while allowing by separate control an independent setting of the time when the green signal will change to yellow.

Another object is to provide such controller wherein the time the traffic actuation is cut off can be set independently of when the green signal is terminated and the yellow signal is started.

A further object is to provide a circuit adjunct having a timing means, which can be connected externally to existing controllers to fulfill the aforestated objectives, and which particularly modifies the controller so that (1) the "YELLOW" knob of the controller can be set to cut off the traffic actuation without changing the time when the green signal will shift to yellow, (2) the "YELLOW" knob cuts off the traffic actuation and simultaneously triggers an advance signal at a preset time before the direction of traffic will change, and (3) the timing means of the adjunct is adjustable to set the time following the advance signal when the green signal will end and the yellow signal will start.

These and other features and objects of the invention will be apparent from the following description and the appended claims.

In the description of my invention reference is had to the accompanying drawings, of which FIG. 1 is a diagram showing a traffic system including a standard traffic-actuated controller, and a circuit adjunct connected externally thereof to adapt the controller for providing an advance signal at a preset interval before the direction of traffic will change in accordance with the invention.

Figure 2:
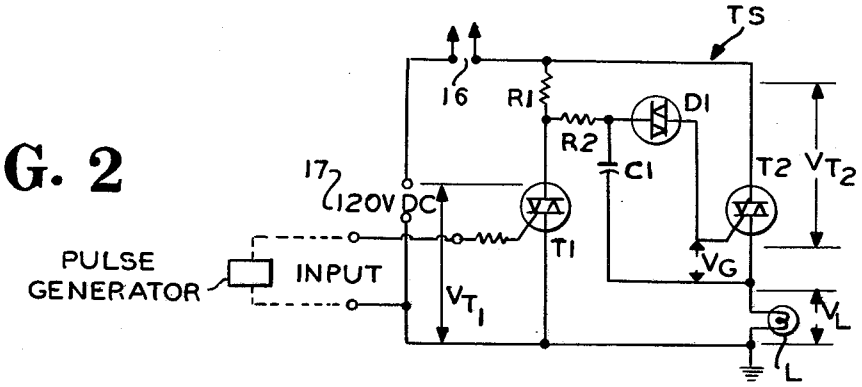

FIG. 2 is a circuit diagram of a standard solid-state Triac switching unit for introducing a blink signal in an output signal circuit of the controller.

Traffic actuated controllers operate from the green signal on each street or road having a car detector unit 10 ahead of the intersection (FIG. 1). Such detector unit is a device actuated by the presence of a car in its vicinity. The green signal consists of a fixed initial interval and an extendible portion comprising one or more extension units controlled according to the traffic flow. The initial interval is set as at 10 to 20 seconds by an "INITIAL" knob 11 on the control panel, and each extension unit is set as at 3 to 4 seconds by a "UNIT EXTENSION" knob 12. As long as there are no cars detected on the side road S having the red signal, and traffic on the main road M has a steady flow causing a car to enter the detection area before each extension unit times out, the extension unit is reset repeatedly to maintain the green signal indefinitely on the main road. However, when a car is detected on the side road S, it starts running a green extension limit set by a "MAXIMUM GREEN" knob 13 on the panel to cause the green signal to end on the main road the instant that limit is reached. On the other hand, if a car is detected on the side road S and an extension unit times out without another car being detected on the main road M, the green signal on the main road is ended immediately. In each case, the end of the green signal is followed by a fixed yellow clearance interval set by the "YELLOW" control knob 14.

When the direction of traffic has changed to the side road S, the green signal on that road may be controlled in the same manner as above described. However, since the side road has usually a minor flow of traffic, retention of the green signal to the same extent as on the main road is not desirable. Thus, although the green signal on the side road will comprise at least an initial interval and one extension unit, the setting of these intervals is generally reduced, and the control may be such that as soon as a car is detected on the main road after the first extension, the green signal will end when that unit extension times out, without provision for any maximum green limit. Still, alternatively, the right-of-way given at any time to the side road may comprise simply a fixed interval.

In present-day traffic actuated systems, as well as in fixed-time systems, there has been no standardization of the yellow clearance interval since this interval is set typically from 2 to 5 seconds at the will of the respective control engineer. The motorist is therefore given no definite information by the yellow light as to when the direction of traffic will change. Rather, because of the varied settings going from one intersection to another there can be confusion leading to accidents.

A feature of the invention covered by the parent application aforementioned is to supplement the yellow signal with a definite-time blink signal in advance thereof, which is standardized nation-wide to give a definite advance notice, say 6 seconds, to enable motorists to gauge their approaches to intersections to save gasoline and achieve greater safety.

Since traffic actuated controllers operate on a floating basis from the green signal until the yellow clearance interval is reached, the timing for the blink signal must stem from the setting of the "yellow" control knob 14. This prescribes the use of a blink signal a short interval ahead of the yellow light—which is desirable because the invention contemplates to blink only the red and green lights. In order to introduce such blink signal ahead of the yellow light in traffic actuated controllers, the invention comprehends setting the "yellow" control knob ahead to the desired setting for the blink signal and causing the traffic actuation to be cut off at that setting, as in the past, and to provide a separate control for setting the time after the blink signal when the green signal is changed to yellow. This is accomplished with existing controllers by means of a circuit adjunct connected externally to the controller. Such circuit adjunct 15M for the main road M operates to trigger a dual pulse monostable generator GM which feeds into Triac switch units TS3 and TS4 in the power lines for the green signal light on the main road M and for the red signal light on the side road S at a selected time before direction of traffic changes at the intersection. Likewise, an adjunct 15S for the side road S includes a generator GS feeding into Triac switch units TS1 and TS6. Both adjuncts are controlled from the green and yellow terminals of the controller for the respective roads, with the result no internal connections have to be made in the controller.

Each standard Triac switch unit TS shown in FIG. 2 is of the negative logic type comprising a power triac T2 connected via terminals 16 in the respective power circuit of the controller between the respective signal light L and the power source 17. When the input Triac T1 of the switch unit TS is triggered "on" by an input pulse from one of the generators, the Triac T2 and the respective signal light L are turned off. When T1 is "off", however, the condenser C1 is charged via the resistors R1 and R2 until breakover occurs of the diac D1, at which instant C1 is discharged into the gate of T2 to turn on the signal light L. Since the Triac T2 is "on" when the input control voltage is zero, and since any failure of a pulse generator usually causes it to have a zero output voltage, the equipment is designed to fail safe.

The adjunct 15M comprises a standard power relay KM1 and a standard normally closed delay relay Km2 having an adjustable knob 18M for setting its timing. The power relay is preferably of the solenoid cam-actuated type to assure against switching failures. These power and delay relays are connected respectively from the terminals of the controller for the green and yellow lights, hereinafter referred to as the green and yellow terminals, for the main road back to ground with the normally closed contacts 18 of the delay relay in series with the coil of the power relay. The power relay has one set of normally closed contacts 19 connecting the yellow terminal to the yellow signal light, and a second set of normally open contacts 20 for connecting the power source 17 to the green terminal in shunt with the respective controller switch Sg. The power relay Km1 is operated the instant power is fed to the green terminal to shunt the controller switch Sg and at the same time to open the circuit to the yellow light long before power is fed to the yellow terminal. When power comes to the yellow terminal it triggers the monostable pulse generator Gm to feed multiple pulse signals to the Triac switch units TS3 and TS4 whereby to cause a multiple blink of the green light on the main road and a multiple blink of the red light on the side road to occur. The delay relay Km2 is energized at the same time but it has a delayed operation according to the setting of the knob 18M to drop the power relay KM1 to cut off the green light and to start the yellow light on the main road, say 3 seconds, after the blink signal.

In operation, the yellow control knob 14 is set to a longer interval than desired for the yellow light by the time desired for the blink signal to precede the yellow light, but at this controller setting only traffic actuation is cut off and the blink signal occurs. The delay relay is set to a time interval equal to the time the controller is set ahead of the desired yellow light, with the result the green light is cut off and the yellow light comes on at the original timing for the yellow light.

The second adjunct 15S for the side road operates in the same manner starting the instant power is fed to the green terminal for the side road. In this second adjunct, the power and delay relays KS1 and KS2, and the pulse generator GS operate to trigger the Triac switching units TS1 and TS6 to blink the red light of the main road and the green light of side road.

These circuit adjuncts can be used as well with standard fixed-time controllers to introduce the blink signal by making only external connections to the controllers.

In resume, as to the standard traffic-actuated controller, such controller operates on a traffic actuated basis until it times out, at which time it shifts to a fixed interval determined by the setting of the "Yellow" knob and causes the yellow light to come on until the direction of traffic changes. The traffic-actuated system herein described operates on a traffic actuated basis until the blink signal occurs, at which time it shifts to a fixed interval, preset nation-wide say to 6 seconds, without terminating the green light at the outset. At a later moment as at the setting desired for the standard traffic-actuated controller, say 3 seconds, the green light is terminated and the yellow light comes on until the direction of traffic is changed.

Whereas in the standard traffic-actuated controller the green light is terminated by a unit extension timing out—i.e., without another car being detected on the road having the green light—after a car is detected on the side road, the present system will delay the terminating of the green light by the time advance of the blink signal ahead of the yellow light, but relative to a timing out of the green light by reaching the "Maximum-Green" setting there is no such delay because this timing out is at a preset interval permitting introduction of the blink signal ahead of the yellow light at any desired maximum green termination through adjustment of the "Maximum Green" knob. The delay in the above first instance is really an advance cut-off of traffic actuation not apparent to the motorist because the yellow clearance period is preserved as before—placing the termination in the same category not existing when maximum-green is reached. True, the lightning trigger action in the first instance by which a change in right-of-way now occurs—responsive even to a transitory gap in traffic flow—is delayed by 2 or 3 seconds, but now for the first time in traffic control history the motorist is given a signal having a fixed time significance by which he can gauge his driving to save gasoline and achieve greater safety. Further, for example, as is described in a subsequent application Ser. No. 165,746 filed July 3, 1980, the motorist can interpret the blink signal solely in relation to the position of his car to a marking post along the roadway when the blink signal occurs, without need for estimating or counting down the time of the blink signal.

The embodiments of my invention herein shown and described are intended to be illustrative and not necessarily limitative of my invention since the same are subject to changes and modifications without departure from the scope of the invention herein claimed.

I claim:

1. The method of controlling the green and red traffic lights of a traffic system having a traffic-actuated controller and red, green and yellow lights on each roadway of an intersection, to provide an advance signal at a predetermined fixed interval before the direction of traffic will change, which comprises momentarily blinking the red and green lights on the respective roadways at the same instant and concurrently cutting off the traffic actuation of said controller at the start of said interval while continuing the green and red lights on said roadways, terminating the green light at a preset time after the blinking signal and concurrently starting the yellow light on the same roadway, and restoring traffic actuation to said controller when the yellow light times out.

2. The method set forth in claim 1, wherein only a green light of the lights of said roadways is blinked the instant the traffic actuation of said controller is cut off.

3. The method of controlling a traffic intersection having a controller with a "Yellow" control knob and red, green and yellow lights for each roadway of the intersection, by providing a momentary blink signal of the green and red lights on the two roadways while continuing the lights in a steady condition on the roadways after the blink signal occurs whereby to give a notice in advance of the yellow light at a predetermined interval before the direction of traffic will change, causing said momentary signal to occur at the setting of said "Yellow" knob, and providing an adjustable delayed action controlled by said knob to cause the green light to be terminated and the yellow light to come on at a preset time after the setting of said "Yellow" knob.

4. The method set forth in claim 3 wherein said controller has output terminals connected respectively to said red, green and yellow lights and wherein said delayed action is accomplished by circuit means connected to the output terminals of the controller.

5. The method set forth in claim 3 wherein said controller is of the traffic-actuated type causing the traffic actuation to be cut off at the setting of said "Yellow" control knob, and restoring the traffic actuation after the yellow light times out whereby a fixed time interval occurs after said blink signal until the direction of traffic is changed.

6. Apparatus comprising means for providing a momentary signal ahead of the yellow light and at a predetermined interval before the direction of traffic changes at a standard intersection to give motorists an advance knowledge when the change occurs, a traffic actuated controller for said intersection having a "Yellow" control knob for setting the timing of the yellow light and for concurrently cutting off the traffic actuation whereby to provide a fixed interval starting at the setting of said knob before the direction of traffic will change, said controller having a power source and having "red", "yellow" and "green" output terminals for each main and side road adapted for connection respectively to the red, yellow and green signal lamps of the respective roads, a delay circuitry for the main road comprising a power relay operated from the green terminal thereof, said relay having a set of normally closed contacts for completing the connection of the yellow terminal to the yellow lamp and a set of normally open contacts for connecting the power source direct to the green terminal of the main road whereby when the relay is operated power is made available direct from said power source to the green lamp and the circuit from the yellow terminal to the yellow lamp is held open, and delay means for dropping said relay when power comes to the yellow terminal of the controller for the main road.

7. The apparatus set forth in claim 6 wherein said delay means comprises a delay relay having an adjustable "on" operation after power is applied to said delay relay, means connecting the coil of the delay relay to the yellow terminal of said controller for the main road to cause the delay relay to be energized the instant power comes to said yellow terminal, and said delay relay having a set of contacts connected to the coil of said power relay causing said power relay to drop out when said delay relay times out, whereby said green light on the main road is terminated and the yellow light comes on after the setting of said "Yellow" knob by a delay equal to the setting of said delay relay.

* * * * *